US006261058B1

(12) United States Patent
Kataoka et al.

(10) Patent No.: US 6,261,058 B1
(45) Date of Patent: Jul. 17, 2001

(54) STATIONARY BLADE OF INTEGRATED SEGMENT CONSTRUCTION AND MANUFACTURING METHOD THEREFOR

(75) Inventors: Masahito Kataoka; Masao Terazaki; Yukihiro Hashimoto, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/414,394

(22) Filed: Oct. 7, 1999

Related U.S. Application Data

(63) Continuation-in-part of application No. 09/049,609, filed on Mar. 27, 1998, now abandoned.

(51) Int. Cl.[7] ..... F01D 9/00
(52) U.S. Cl. ..... 415/189; 415/208.2; 415/209.4
(58) Field of Search ..... 415/189, 191, 415/208.2, 209.2, 209.4, 210.1

(56) References Cited

U.S. PATENT DOCUMENTS

| | | | | |
|---|---|---|---|---|
| 4,015,910 | | 4/1977 | Harmon et al. . | |
| 4,233,342 | | 11/1980 | Aichert et al. . | |
| 5,014,293 | | 5/1991 | Boyd et al. . | |
| 5,427,866 | * | 6/1995 | Nagaraj et al. | 428/610 |
| 5,462,403 | * | 10/1995 | Pannone | 415/173.1 |
| 5,514,482 | * | 5/1996 | Strangman | 428/623 |
| 5,558,922 | | 9/1996 | Gupta et al. . | |
| 5,562,998 | * | 10/1996 | Strangman | 428/612 |
| 5,591,003 | * | 1/1997 | Boyd et al. | 415/209.2 |
| 5,653,581 | | 8/1997 | Dixon et al. . | |
| 5,683,761 | * | 11/1997 | Bruce et al. | 427/255.3 |
| 6,050,776 | * | 4/2000 | Akagi et al. | 415/209.4 |

FOREIGN PATENT DOCUMENTS

| | | | | |
|---|---|---|---|---|
| 779060 | * | 7/1998 | (GB) | 415/189 |
| 8-255958 | * | 9/1996 | (JP) . | |
| 10-196308 | * | 7/1998 | (JP) . | |
| 11-93609 | * | 7/1998 | (JP) . | |

* cited by examiner

*Primary Examiner*—Edward K. Look
*Assistant Examiner*—James M McAleenan
(74) *Attorney, Agent, or Firm*—Alston & Bird LLP

(57) ABSTRACT

The present invention provides a stationary blade of integrated segment construction, in which a thermal barrier coating can be applied to the whole blade surface and excessive stress can be avoided in a shroud. A plate seat connector is provided at each end face portion of an inside shroud and an outside shroud attached to outside and inside ends of gas turbine stationary blade. Several stationary blades are integrated by joining the plate seat connectors of the adjacent shrouds by means of bolts and nuts to provide a stationary blade of integrated segment construction.

11 Claims, 2 Drawing Sheets

STATIONARY BLADE OF INTEGRATED SEGMENT CONSTRUCTION AND MANUFACTURING METHOD THEREFOR

CROSS-REFERENCE TO RELATED APPLICATIONS

This application is a continuation-in-part of U.S. patent application Ser. No. 09/049,609, filed on Mar. 27, 1998, now abandoned which is hereby incorporated herein in its entirety by reference.

FIELD AND BACKGROUND OF THE INVENTION

The present invention relates to a gas turbine stationary blade and, more particularly, to a gas turbine stationary blade of such a construction that a thermal barrier coating (TBC) can be applied to the blade surface and cracks can be prevented from being made by thermal stresses at the shroud portion of the blade.

FIG. 4 is a perspective view of a conventional gas turbine stationary blade, and FIG. 5 is a plan cascade view of a plurality of blades. One inside shroud 11 and one outside shroud 12 are provided with respect to one stationary blade 1 as shown in FIG. 4.

The stationary blade 1 has a construction such that a seal plate (not shown) is put between the shrouds, which are adjacent to each other, by which the leakage of cooling air is decreased. When a single blade construction, in which blades are divided separately, is used because of the need for applying a thermal barrier coating to the blade surface, the number of portions where seal plates are inserted increases, resulting in increased leakage of cooling air.

In order to decrease the leakage of cooling air, several stationary blade can be cast as an integrated, one-piece segment, or single cast blades can be joined by welds into an integrated segment. In these cases, however, a thermal barrier coating cannot be applied to the whole surface of the blade.

As describe above, the decrease in leakage of cooling air caused by blade division is prevented conventionally by one-piece casting of a plurality of stationary blades as an integrated segment or by welding individual cast blades into an integrated segment. However, if singly cast blades are welded into an integrated segment, high thermal stresses cannot be relieved by the temperature difference between the dorsal side and ventral side of blade, so that the potential for the generation of cracks in the shroud is increased.

With the recent increase in gas turbine inlet temperatures, thermal barrier coatings etc. are applied to the blade surface by spraying, using a coating gun, to reduce the thermal load of blade surface to the utmost. In this case, if multiple stationary blades are cast as a one-piece cast integrated segment, or if singly cast blades are welded into an integrated segment, the coating gun typically does not enter a curvedly space formed between the blades, so that the coating cannot be readily applied to the whole blade surface.

SUMMARY OF THE INVENTION

The present invention was made to address the above problems. Accordingly, an object of the present invention is to provide a gas turbine stationary blade of integrated segment construction, in which a thermal barrier coating can be applied to the whole blade surface, and in which excessive stresses are not produced in the shroud, and to a manufacturing method for such blades.

To achieve the above object, the present invention provides a gas turbine stationary blade segment having a plate seat connector adapted to receive a bolt, affixed at each end face portion of inside and outside shrouds affixed to a gas turbine stationary blade. Each plate seat connector protrudes outwardly away from the respective shroud to which it is affixed and includes a flat seat face which is not contiguous with the end face of the shroud. The stationary blade segments are integrated by joining the plate seat connectors of adjacent shrouds in face to face contact by means of bolts and nuts.

In the stationary blade of integrated segment construction in accordance with the present invention, it is preferable that a thermal barrier coating be applied to the whole surface of the stationary blade to reduce thermal load on the stationary blade surface.

To manufacture the above-mentioned stationary blade of integrated segment construction in accordance with the present invention, after a thermal barrier coating is applied to the blade portion of each stationary blade segment, several stationary blade segments are integrated by the joining the plate seat connectors by means of bolts and nuts. Accordingly, an integrated segment stationary blade having a thermal barrier coating applied to the whole surface of each blade can be manufactured easily.

By employing the stationary blade of integrated segment construction in accordance with the present invention, the number of seals inserted between the blades can be decreased, so that the leakage of cooling air can be reduced, whereby the performance of gas turbine is improved.

Preferably, the width of each plate seat connector, i.e., across the seat face, is small compared to the width of the corresponding shroud. In addition, preferably each plate seat connector includes a flexible leg portion which connects the outermost seat face portion of the plate seat connector with the shroud and which is constructed to flex in response to stress applied to the connector as a result of thermal deformation of the shroud.

Because the seat face of each plate seat connector is separate from, i.e., non-contiguous, with the end face of the shroud, when an excessive force is applied to the stationary blade segment of the present invention as a result of thermal expansion, a relative slide can occur at the seating face of the bolted plate seat connector, by which excessive stress in the shroud portion of the segment can be prevented, i.e., relieved. Also, because the stationary blade segments can easily be disassembled into individual blade segments by removing the bolts, a coating gun can readily reach the whole blade surface, so that the whole blade surface can be coated.

As described above, in the gas turbine stationary blade segment in accordance with the present invention, the plate seat connector is provided at each end face portion of the inside shroud and the outside shroud of the gas turbine stationary blade segment, and several stationary blade segments are integrated by joining the plate seat connectors of the adjacent shrouds by means of bolts and nuts. Because a plurality of the stationary blade segments are mechanically joined in an integrated segment construction, the number of locations where seals are inserted can be decreased so that the leakage of cooling air can further be reduced, whereby the performance of gas turbine can be improved.

Also, with the stationary blade segment in accordance with the present invention, since a thermal barrier coating can be applied to the whole blade surface by performing the thermal barrier coating operation before joining the plate seats by means of bolts and nuts, the thermal load on the blade can be reduced, so that the blade segment can tolerate higher gas turbine temperatures.

Further, since the thermal deformation caused by the temperature difference between the dorsal side and ventral side of turbine blade can be absorbed by relative sliding between the bolted faces of the plate seat connectors, an excessive stress created in the shroud can be prevented, so that the reliability of the blade is increased. Moreover, in preferred embodiments in which a flexible leg connects the seat face portion of the plate seat connector to the shroud, flexing of the leg provides additional relief of stress between the shroud and the plate seat connector.

As described above, the present invention achieves substantial and desirable effects contributing to increased reliability and performance of gas turbines.

DETAILED DESCRIPTION OF THE INVENTION

Figure 1:
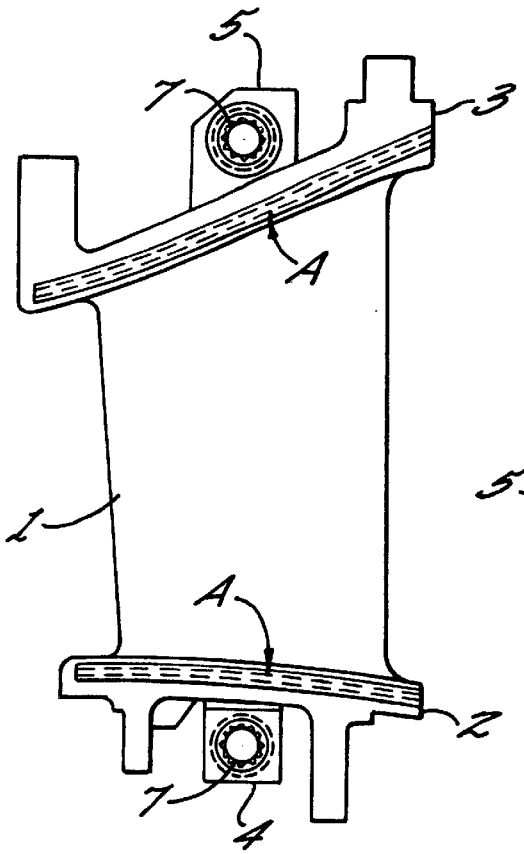
FIG. 1 is an elevation view showing a stationary blade segment for integrated segment construction in accordance with one embodiment of the present invention.
Figure 2:
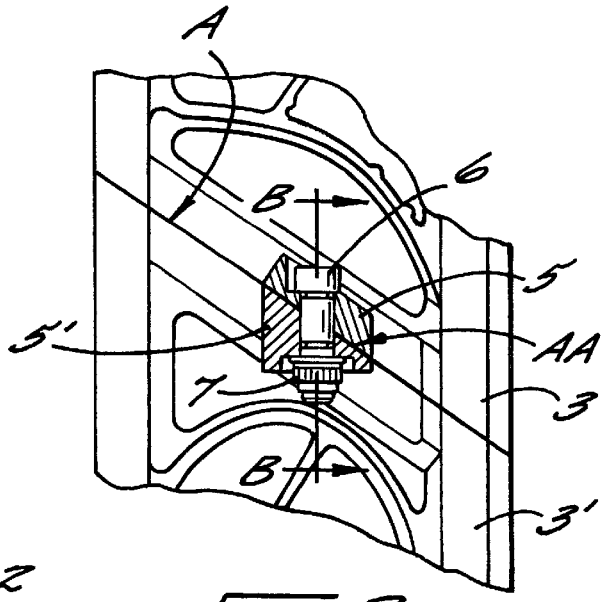
FIG. 2 is a plan view of the stationary blade segment of integrated segment construction shown in FIG. 1.
Figure 3:
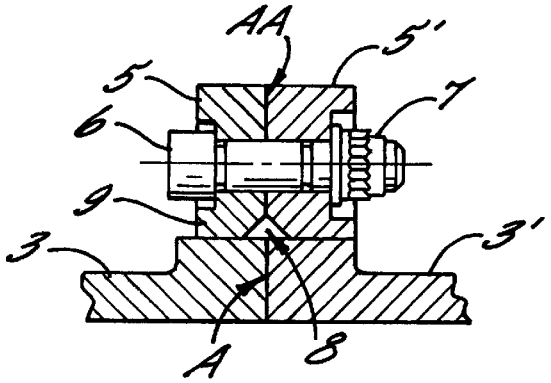
FIG. 3 is a sectional view taken along the line B—B of FIG. 2, showing two plate seat connectors of adjacent shrouds connected in face to face contact via connecting bolts.

Preferred embodiments of the present invention will be described in detail with reference to the accompanying drawings. In FIGS. 1 to 3, reference number 1 denotes the stationary blade of the blade segment, reference numeral 2 denotes an inside shroud of the segment, and numeral 3 denotes an outside shroud of the segment. The stationary blade 1 is joined at its inside and outside ends between the shrouds 2 and 3. At each end of the inside shroud 2 and outside shroud 3, plate seat connectors 4 and 5 are affixed respectively and extend outwardly away from the respective shroud. These plate seat connectors 4 and 5 each are formed with a bolt hole for inserting a bolt 6. As shown in FIG. 2, the plate seat connectors 4 and 5 of the adjacent shrouds 2 and 3 are joined mechanically by means of the bolts 6 and nuts 7, by which several single blade segments are joined into an integrated segment.

As seen in FIGS. 1, 2, and 3, each shroud includes an end face A which is secured into face to face contact with an opposing in face A of an adjacent shroud, (3 and 3' in FIGS. 2 and 3), when the plate seat connectors 5 and 5' are secured in face to face contact along their respective seating faces AA. As best seen in FIG. 3, each plate seat connector 5 and 5' includes a notch cavity 8 between the connecting face AA of the plate seat connector 5 and the shroud, 3, to which it is secured. The notch 8 isolates the connecting face AA of the plate seat connector 5 from the face A of the shroud 3 so that the connecting faces AA and A of the plate seat connector 5 and the shroud 3, respectively, are non-contiguous with respect to each other. Accordingly, thermal expansion of the shroud 3 along the end face A of the shroud transmits a stress to the connecting face AA of the plate seat connector along a connecting portion 9 of the connector. However, each of the two faces A and AA, respectively, of the shroud 3 and the plate face connector 5, can experience movement and/or thermal expansion without directly causing a corresponding movement or expansion of the other face, i.e., movement or expansion is transmitted along the connection portion 9.

Figure 3A:
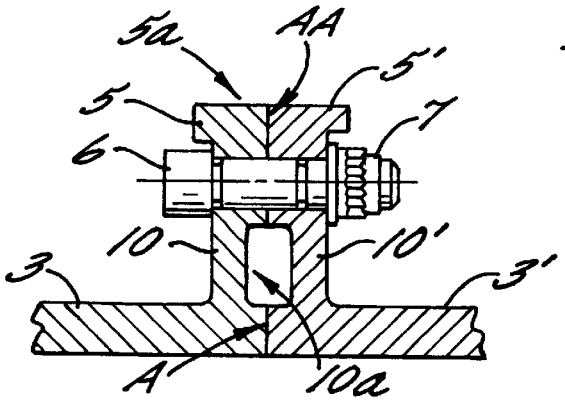
FIG. 3*a* is a sectional view of another preferred plate seat connector according to another aspect of the invention wherein the connector includes a flexible leg portion.
Figure 4:
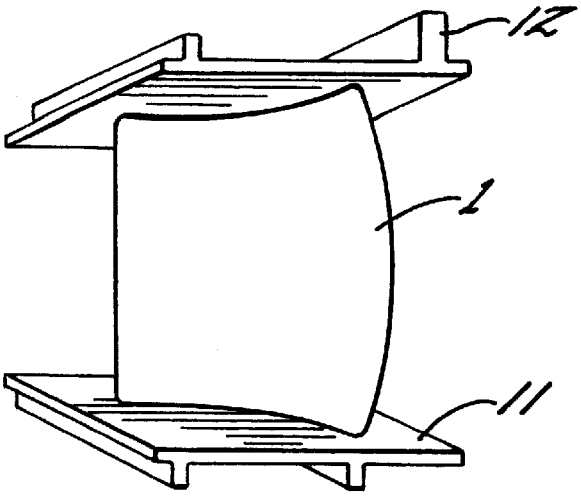
FIG. 4. (PRIOR ART)
FIG. 4 is a perspective view showing a construction of a conventional gas turbine stationary blade.
Figure 5:
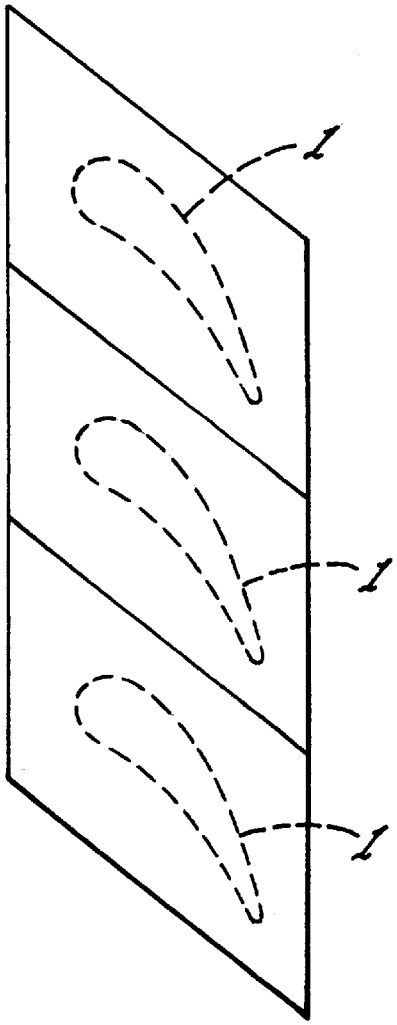
FIG. 5. (PRIOR ART)
FIG. 5 is a plane cascade view illustrating a plurality of conventional gas turbine stationary blades integrated together.

FIG. 3*a* illustrates a preferred embodiment of the invention in which a connecting leg 10 is provided between the shroud 3 and the outward most portion 5*a* of the plate face connector 5 which includes the seating face AA. The connector is shown connected in face to face contact with an opposing connector 5' via bolt 6 and nut 7. The connecting leg 10 has a thickness in the direction transverse to the seating or connecting face AA of the connector 5, which is substantially less than the thickness of the plate face connector 5 in the outermost portion 5*a* thereof. Because the flexible leg 10 is thinner than the upper portion 5*a* of the plate seat connector, the leg 10 can flex or bend in response to thermal deformation of the shroud 3. This flexing capability relieves a portion of the stresses in the shroud and also reduces the tensile stresses that would otherwise be placed on the bolt 7 when the hotter front portion of the shroud 3 expands differentially with respect to the rear cooler portion of the shroud.

The plate seat connecting members illustrated in each of FIGS. 3 and 3*a* are affixed to the corresponding shroud 3 so that the connecting face AA of the plate seat connector 5 is coplanar with the end face A of the corresponding shroud. The plate seat connector is preferably a substantially flat, plate-like structure having a thickness in the direction transverse to the connecting face AA which is smaller than the height dimension of the connector, i.e., the distance that the connector extends outwardly of the shroud 3. The plate seat connector can be formed integrally with the shroud, i.e., as an integrally cast element of a cast shroud. Alternatively, the plate seat connector can be formed separately from the shroud 3 and subsequently fixed to the shroud by welding.

In each of the plate seat connectors illustrated in FIGS. 3 and 3A, the connecting faces AA of the plate seat connector 5 is isolated from the end face A of the corresponding shroud via a cavity extending laterally across an outer surface of the connector. In the connector of FIG. 3, the cavity has a cross-sectional shape of a notch. The cavity is provided in the form of an elongate cavity 10*a* in the case of the connector illustrated in FIG. 3A. As indicated previously, the cavities 8 and 10*a* serve to isolate the seating face AA of the plate face connector 5 from the end face A of the shroud. The flexible leg 10 provided in the structure illustrated in FIG. 3*a* provides a substantially improved flexibility between the upper connecting portion 5*a* of the plate face connector as compared to the notch cavity 8 illustrated in FIG. 3. In this regard, it will be apparent to those of skill in the art that the notch 8 of FIG. 3 functions to concentrate bending stresses at the lower portion of the notch. In contrast, the leg 10 employed in the connector of FIG. 3*a* distributes bending stress along its height to provide substantially increased stress relief between the shroud 3 and the connecting face AA of the plate face connector 5.

Accordingly, the present invention provides a turbine blade construction in which several stationary blade segments 1 are integrated to form an integrated multiple blade segment. By using this construction, when an excessive force due to a thermal stress is applied to the shroud, a relative sliding can occur on the seat faces AA of the plate seat connectors 4 and 5 and along the abutting end faces A of the shrouds 2 and 3, so that thermal stress can be prevented from causing cracks in the shroud portion of the blade segment. Also, the whole surface of blade can be coated because the blade segments can easily be disassembled into individual blade segments by removing the bolts 6.

Thus, the present invention also provides an improved manufacturing process wherein an integrated segment construction comprising a plurality of blade segments can be obtained by integrating several stationary blade segments 1 by joining the plate seat connectors 4 and 5 of the adjacent shrouds 2 and 3 by means of the bolts 6 and nuts 7 after a thermal barrier coating is applied to the entire surface of each stationary blade 1.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A stationary blade segment for an integrated segment construction including a plurality of stationary blades for a gas turbine comprising:

a blade having outer and inner ends, an outside shroud joined to the outer end, and an inside shroud joined to the inner end, each shroud having an end face portion adapted to abut an end face portion of an adjacent stationary blade segment shroud; and a plate seat connector affixed at each end face portion of the inside shroud and the outside shroud, each plate seat connector extending outwardly away from its corresponding shroud and comprising a flat seat face at an outer portion thereof, each of said plate seat connectors being adapted to receive a bolt for securing the seat face thereof in face to face contact with the seat face of an adjacent plate seat connector, the seat face of each said plate seat connector being non-contiguous with respect to the end face of the end face portion of the shroud to which said connector is affixed.

2. The stationary blade segment according to claim 1 comprising a thermal barrier coating on substantially the whole surface of the stationary blade portion of said stationary blade segment.

3. A stationary blade segment according to claim 1 wherein said seat face of said plate seat connector is coplaner with respect to the end face of the end face portion of the shroud to which said connector is affixed, and wherein said plate seat connector comprises a cavity along an exterior surface thereof positioned between said coplaner end faces of said plate seat connector and said end face of said shroud whereby said cavity isolates said coplaner faces from each other.

4. A stationary blade segment for an integrated segment construction including a plurality of stationary blades for a gas turbine comprising:

a blade having outer and inner ends, an outside shroud joined to the outer end, and an inside shroud joined to the inner end, each shroud having an end face portion adapted to abut an end face portion of an adjacent stationary blade segment shroud; and a plate seat connector affixed at each end face portion of the inside shroud and the outside shroud, each plate seat connector extending outwardly away from its corresponding shroud and comprising a flat seat face at an outer portion thereof, each of said plate seat connectors being adapted to receive a bolt for securing the seat face thereof in face to face contact with the seat face of an adjacent plate seat connector, the seat face of each said plate seat connector being non-contiguous with respect to the end face of the end face portion of the shroud to which said connector is affixed, and further comprising a flexible leg connected between each said shroud and an outer portion of said plate seat connector comprising the seat face thereof.

5. A stationary blade segment for an integrated segment construction including a plurality of stationary blades for a gas turbine comprising:

a blade having outer and inner ends, an outside shroud joined to the outer end, and an inside shroud joined to the inner end, each shroud having an end face portion adapted to abut an end face portion of an adjacent stationary blade segment shroud; and a plate seat connector affixed at each end face portion of the inside shroud and the outside shroud, each plate seat connector extending outwardly away from its corresponding shroud and comprising a flat seat face at an outer portion thereof, each of said plate seat connectors being adapted to receive a bolt for securing the seat face thereof in face to face contact with the seat face of an adjacent plate seat connector, the seat face of each said plate seat connector being non-contiguous with respect to the end face of the end face portion of the shroud to which said connector is affixed, and further comprising a flexible leg connected between each said shroud and an outer portion of said plate seat connector comprising the seat face thereof, wherein said flexible connecting leg has a thickness, in a direction transverse to said seat face, which is less than the dimension of said plate face connector in the same direction in said outer portion thereof.

6. The stationary blade segment according to claim 1 wherein said plate seat connector has a width in a direction across said seat face thereof which is substantially less than the width of said shroud in the same direction.

7. A stationary blade segment for an integrated segment construction including a plurality of stationary blades for a gas turbine comprising:

a blade having outer and inner ends, an outside shroud joined to the outer end, and an inside shroud joined to the inner end, each shroud having an end face portion adapted to abut an end face portion of an adjacent stationary blade segment shroud;

a plate seat connector affixed at each end face portion of the inside shroud and the outside shroud, each plate seat connector extending outwardly away from its corresponding shroud and comprising a flat seat face at an outer portion thereof, each of said plate seat connectors being adapted to receive a bolt for securing the seat face thereof in face to face contact with the face of an adjacent plate seat connector, the seat face of each said plate seat connector being non-contiguous with respect to the end face of the end face portion of the corresponding shroud; and each of said plate seat connectors including a flexible leg connected between said shroud and said outer portion of said connector including said seat face.

8. The stationary blade segment according to claim 7 comprising a thermal barrier coating on substantially the whole surface of the stationary blade portion of said stationary blade segment.

9. The stationary blade segment according to claim 7 wherein said flexible connecting leg has a thickness, in a direction transverse to said seat face, which is less than the dimension of said plate face connector in the same direction in said outer portion thereof.

10. The stationary blade segment according to claim 7 wherein said plate seat connector has a width in a direction across said seat face thereof which is substantially less than the width of said shroud in the same direction.

11. A manufacturing process for manufacturing an integrated segment construction including a plurality of stationary blades comprising the steps:

applying a thermal barrier coating to each blade of a plurality of stationary blade segments, each of said segments having an outside shroud and an inside shroud connected to outer and inner ends of one of said stationary blades, each shroud having an end face portion adapted to abut an end face portion of an adjacent stationary blade segment shroud; and joining the stationary blade segments into an integrated segment construction by bolting together corresponding plate seat connectors, each of said plate seat connectors being affixed to and extending outwardly away from an end face portion of one of said shrouds, each of said plate seat connectors including a seat face which is non-contiguous with respect to the end face of the end face portion of the shroud to which said connector is affixed.

* * * * *

UNITED STATES PATENT AND TRADEMARK OFFICE

CERTIFICATE OF CORRECTION

PATENT NO. : 6,261,058 B1
DATED : July 17, 2001
INVENTOR(S) : Kataoka et al.

It is certified that error appears in the above-identified patent and that said Letters Patent is hereby corrected as shown below:

Title page,
Item [56], References Cited, FOREIGN PATENT DOCUMENTS,
Line 1, "7/1998" should read -- 7/1957 --;
Line 2, "8-255958" should read -- 8-225958 --;
Line 4, "7/1998" should read -- 4/1999 --.

Signed and Sealed this

Twenty-ninth Day of January, 2002

*Attest:*

*Attesting Officer*

JAMES E. ROGAN
*Director of the United States Patent and Trademark Office*